United States Patent [19]

Block

[11] 4,361,075

[45] Nov. 30, 1982

[54] UNLOCKABLE CHECK VALVE, PARTICULARLY FOR USE AS RECOVERY AND SETTING VALVE IN UNDERGROUND MINING

[75] Inventor: Siegmar Block, Essen, Fed. Rep. of Germany

[73] Assignee: Thyssen Industrie AG, Fed. Rep. of Germany

[21] Appl. No.: 206,982

[22] Filed: Nov. 14, 1980

[30] Foreign Application Priority Data

Nov. 20, 1979 [DE] Fed. Rep. of Germany ..... 2946765

[51] Int. Cl.[3] ..... F15B 15/26

[52] U.S. Cl. ..... 91/420

[58] Field of Search ..... 91/420, 447

[56] References Cited

U.S. PATENT DOCUMENTS 2,926,634 3/1960 Falendysz ..... 91/420 X 3,587,399 6/1971 Parquet ..... 91/420

FOREIGN PATENT DOCUMENTS 561814 7/1977 U.S.S.R. ..... 91/420

*Primary Examiner*—Robert G. Nilson

*Attorney, Agent, or Firm*—McGlew and Tuttle

[57] ABSTRACT

An improved valve in use for underground mining in connection with a piston cylinder unit, such as a hydraulic prop, is disclosed. The valve includes a piston member within a control chamber which is operative to terminate fluid communication between the hydraulic prop and a hydraulic fluid source. The piston is pressure-equalized in a neutral position when the hydraulic prop is set.

6 Claims, 4 Drawing Figures

UNLOCKABLE CHECK VALVE, PARTICULARLY FOR USE AS RECOVERY AND SETTING VALVE IN UNDERGROUND MINING

FIELD AND BACKGROUND OF THE INVENTION

The present invention relates, in general, to check valves used in underground mining and, more particularly, to a new and useful check valve for use in connection with piston-cylinder arrangements in which the piston can be alternately subjected to hydraulic pressure in both sides such as are found in hydraulic props, thrust piston gears and pushing rams in underground mining.

In underground mining operations, the use of unlockable check valves is known in which such valves are used as recovery and setting valves for hydraulically operated mining props. The known unlockable check valves include a housing having a control space with a piston-type control element in which a piston rod is integrally connected on one side. The piston rod is displaceable in axially guided relationship with a housing extension and sealingly engages the housing extension. The piston rod projects toward the direction of a spring loaded shutoff device that can be forced into an open position by the movement of the piston rod against the restoring force of the spring. The shutoff device normally isolates a setting space in the cylinder housing in the hydraulic prop or the like, which is under fluid pressure, from a return pipe. The piston rod projects through an outlet space. The outlet space is connected to a return pipe which has a connection to the outlet side of the shutoff device. In addition, the outlet space is connected via conduits to the piston rod side of the control space, while the portion of the control space on the opposite side of the piston-type control element is connected to another return pipe which can be connected, however, to the same return flow as the return pipe connected to the outlet space. In this way, the piston-type control element is hydraulically pressure-equalized on both sides in the neutral position of the check valve, that is, after the respective prop or the like has been set. Accordingly, back pressure or back flow in the return flow channel cannot cause a displacement of the piston-type control element. Thus, the unlockable check valve maintains a neutral disposition, that is, accidental opening of the shutoff device is impossible. A disadvantage of this known design, however, is that the valve tends to flutter upon the occurrence of unavoidable expansion blows or pressure relief shocks.

Another known unlockable check valve is principally designed like the above-described check valve but includes a piston rod which is integrally connected with the piston-type control element and is displaceable in axially guided sealing relationship in a housing set having an outlet space sealed in a fluid-tight manner from the control space. Thus, the control element is not pressure-equalized in a neutral position of the check valve such as when the prop has been set, that is, the cylinder spaces of the control space on both sides of the piston-type control element are subjected to different pressure medium pressures.

The advantage of such an unlockable check valve is that the pressure peaks originating from an expansion blow, cannot act, through the outlet space, on the annular face of the piston-type control element with which the piston rod is associated. Consequently, expansion blows do not lead to a displacement of the control element against a control pressure. The pressure of the pressure fluid remains, therefore, about the same in the outlet chamber and can diminish slowly through the return line to the return flow channel connected here.

A disadvantage of this known design is that the fluid pressure can unilaterally act on the control element due to a back-pressure in the return flow line. It is thus possible, for example, that the dynamic back-pressure pressure will displace the control element, and thereby the piston rod, in the direction of the shutoff device to move the shutoff device into the open position. This may cause an accidental relief of the prop space which is pressurized by the pressure or working fluid, so that the prop gives way accidentally. In practice it happens now and again that hydraulic mine props are set with a low fluid pressure to protect the roof. In the case of accidental relief in props set at such low pressure, the roof will no longer underpin, which can have serious consequences.

SUMMARY OF THE INVENTION

The invention is based on the problem of preserving the advantages of the above-described known designs in an unlockable check valve while avoiding their disadvantages. Accordingly, the inventive arrangement assures that the control element is pressure-equalized in neutral position but that any expansion blows occurring when the shutoff device is lifted from its sealing position no longer have an adverse effect on the control element.

In the neutral position of the check valve, the piston-type control element is pressure-equalized, that is, accidental retracting of the respective piston-cylinder unit, e.g., a hydraulic prop, due to backpressure or back flow in the return flow is no longer possible.

For retracting the respective piston-cylinder unit, for example, for retracting a hydraulic prop, the piston-type control element is unilaterally subjected to pressure fluid via a suitable control. After a certain closing stroke of the control element, the fluid-conducting connection between the outlet chamber and the portion of the control space that can be brought into a fluid-conducting connection with the outlet chamber is interrupted. Thus the unavoidable hydraulic expansion blows, or pressure relief shocks can no longer cause a displacement of the control element. This ensures that objectionable buzzing or fluttering of the check valve is avoided. Even if hydraulic pressure peaks occur during the retraction, the opening cross section of the valve is kept so constant that a continuous pressure decrease is ensured. The valve and the entire timbering construction are protected thereby.

In accordance with a preferred embodiment of the invention, a constructionally simple, but very rugged and compact design is obtained. In this alternate embodiment, the preferably piston-type control element, the piston rod integrally connected with it, the axial chanel, the valve seats, the check valve and the shutoff device are arranged preferably coaxially to each other inside a cartridge-type housing. After a certain closing stroke, the piston rod strikes against the shutoff device, so that the mouth of the axial channel, which is surrounded by a valve seat, that extends centrically in the piston rod, is closed. The fluid-conducting connection between control space and outlet space is thereby interrupted. The fluid displaced during the stroke of the control element in the direction of the shutoff device is pushed by the control element into the outlet space. The pressure fluid issuing during the ascending movement of the shutoff device pushes the check valve again down on its seat so that no pressure fluid can enter the control space through it.

The check valve opening in the direction of the outlet space is arranged in a connecting channel which connects the outlet space with the control chamber. This way the fluid displaced during the movement of the control element is pushed over the check valve into the outlet space. Instead of such a connecting channel with a check valve can also be provided several connecting channels, if this should be necessary or expedient.

Accordingly, it is an object of the invention to provide an improved valve for use in underground mining in connection with a piston cylinder unit having a member slidably mounted in the bore of the cylinder for displacement responsive to fluid pressure in first and second compartments in the cylinder on opposite sides of the member. The improved valve includes an elongated housing having the control chamber, a valve chamber, and an outlet chamber intermediate the control chamber and the valve chamber. A piston member is provided which is slidably mounted for axial displacement within the control chamber in fluid-type contact with the housing to divide the control chamber into a first control chamber and a second control chamber portion. A first spring, within the second control chamber portion, resiliently biasing or urges the piston member in a first direction toward the first control chamber portion. A first channel for establishing fluid communication between the first compartment and the first control chamber portion and a second channel for establishing a path of fluid communication between the second compartment and the second control chamber portion through the valve chamber are provided. A shutoff member is provided in the valve chamber for closing the path. The shutoff means is operatively responsive to the displacement of the piston member in a second direction opposite to the first direction over a first predetermined distacne to open the path. Connection means, such as a conduit, for establishing fluid communication is provided between the second control chamber portion and the outlet chamber. The piston member is displaceable in the second direction over a second predetermined distance less than the first predetermined distance to shut off fluid communication between the second control chamber portion and the outlet portion. Conduits are provided for fluidly interconnecting the first channel and the outlet chamber when the piston member is in a neutral position, that is, at a distance from the first control chamber portion less than the second predetermined distance. In accordance with a preferred embodiment of the invention, the piston member includes an elongated piston rod connected at a first end to the piston member and projecting through the second control chamber portion toward the shutoff member, and means are provided for axially guiding the piston rod. The piston rod, in accordance with this preferred embodiment, has an axial channel extending therethrough to form a fluid conducting connection between a second control chamber portion and the outlet chamber and centrically terminates in a second end of the piston rod. The second end forms a seating surface for sealingly engaging the shutoff member.

A check valve is mounted to the piston rod in the outlet chamber, and a bypass line establishes fluid communication between the second control chamber portion and the outlet chamber. A second spring in the outlet chamber resiliently urges the check valve toward the control chamber to close the bypass line for preventing backflow from the outlet chamber to the second control chamber portion.

In accordance with another preferred embodiment of the invention, a tubular piston rod is axially displaceably mounted to the housing in a fluid-tight manner intermediate the second control chamber portion and the outlet chamber. The piston rod has a longitudinal axis channel extending therethrough to form a fluid conducting connection between the second control chamber portion and the outlet portion. The piston member, in accordance with this embodiment, is displaceable in the second direction to engage the piston rod and seal the axial channel at a first end of the piston rod and the piston rod has a second end forming a seating surface for sealingly engaging the shutoff member.

In accordance with the invention, an improved valve for use in underground mining in connection with a piston cylinder unit, such as a hydraulic prop, mine prop, is provided which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION

Figure 1:
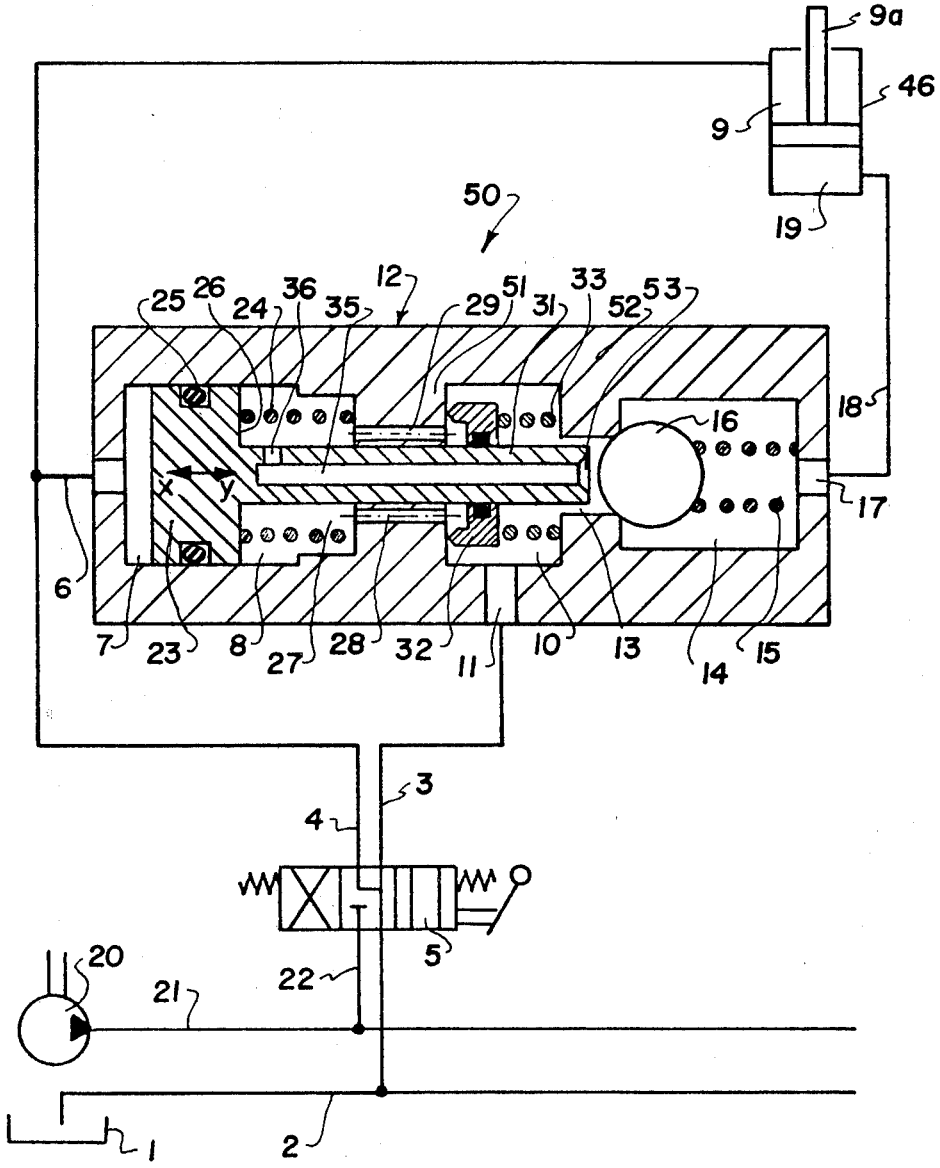
FIG. 1 illustrates a combined longitudinal cross-sectional view of a valve made in accordance with the invention in combination with a schematic circuit representation of an interconnection with a mine prop.

Referring now to the drawings, in particular, wherein like reference characters designate like or corresponding parts throughout the several views, there is shown a valve 50 which comprises a cylindrical housing 12 having a plurality of separate compartments designated as control space 8, outlet chamber 10, and valve chamber 14. A connecting channel 13 interconnects valve chamber 14 and outlet chamber 10, and a bypass 28,29 or 30 interconnects the control space 8 and outlet chamber 10 as described hereinafter in detail. A piston-type control element 23 is slidably mounted in control space 8, in sealing engagement with the inner wall of the housing 12, and divides the control space into two parts 7,27.

As shown in the drawing, a tank 1 for holding a reservoir of a suitable hydraulic fluid, for example, a water-oil emulsion, used for actuating underground piston-cylinder units such as hydraulic mine props, hydraulic stop supports, advance cylinders, and the like. A return flow conduit 2 opens into tank 1. Return pipes 3 and 4 are connectable to conduit 2 via a multiple path or multiway valve 5.

Return pipe 4 is connected over a branch line section 6 to a portion 7 of a control space 8, which is in all embodiments cylindrical, and also to a prop rod space 9 of a hydraulic piston-cylinder unit or a hydraulic prop 46. Return pipe 3 is in fluid-conducting communication or connection with outlet chamber 10 over an opening channel 11 in a housing 12. Outlet chamber 10 is lockably connected over a connecting channel 13 to a valve chamber 14 in which a spring element 15, designed as a compression spring, is arranged. The spring element 15 bears, on the one hand, against housing 12, and on the other hand, against a shutoff device 16 which is illustrated in the form of a sphere in FIG. 1. Valve chamber 14 has fluid connection or communication over an opening or channel 17 in housing 12 with a pressure pipe 18, which opens into a setting space 19 of hydraulic prop 46 which defines the space opposite prop rod space 9. A suitable pressure fluid source 20, which is connected to a pressure fluid pipe 21, is connectable over a line section 22 and multiway valve 5 either to return pipe 3 or to return pipe 4.

In control space 8, a piston-type control element 23 is axially guided in sealing engagement and longitudinally sliding relation, in direction X or Y relative to elongated housing 12 in all embodiments shown in the drawing. The displacement in direction Y becomes possible only upon overcoming the resilient restoring force of a compression spring element 24 in control space 8. The piston-type control element 23 is sealed, relative to inner wall of the housing, in all represented embodiments through a suitable seal 25, such as an O-ring, located in control space 8. The compression spring element, which is arranged in control space portion 27, bears at one end against a face 26, of the element 23 and at the other end against an annular extension 51 of housing 12. In all embodiments shown in the drawing, the control space portion 27 receiving compression spring element 24 is connected in a fluid-conducting manner to outlet chamber 10. To this end, the two bypasses 28 and 29 are provided in the embodiments shown in FIG. 1. In the embodiments according to FIGS. 2 and 4, only one such bypass 30 connects outlet chamber 10 with control space portion 27 in a fluid-conducting manner.

In the embodiment of FIG. 1, bypasses 28 and 29 are kept normally closed by a check valve which is composed of a displaceable valve body 32, slidably connected with control element 23, and a compression spring 33. Compression spring 33, which bears against an annular housing extension 52, urges valve body 32 against annular housing extension 51, designed as a valve seat to close the bypasses 28 and 29 in a fluid-tight in the position as shown in FIG. 1.

Figure 2:
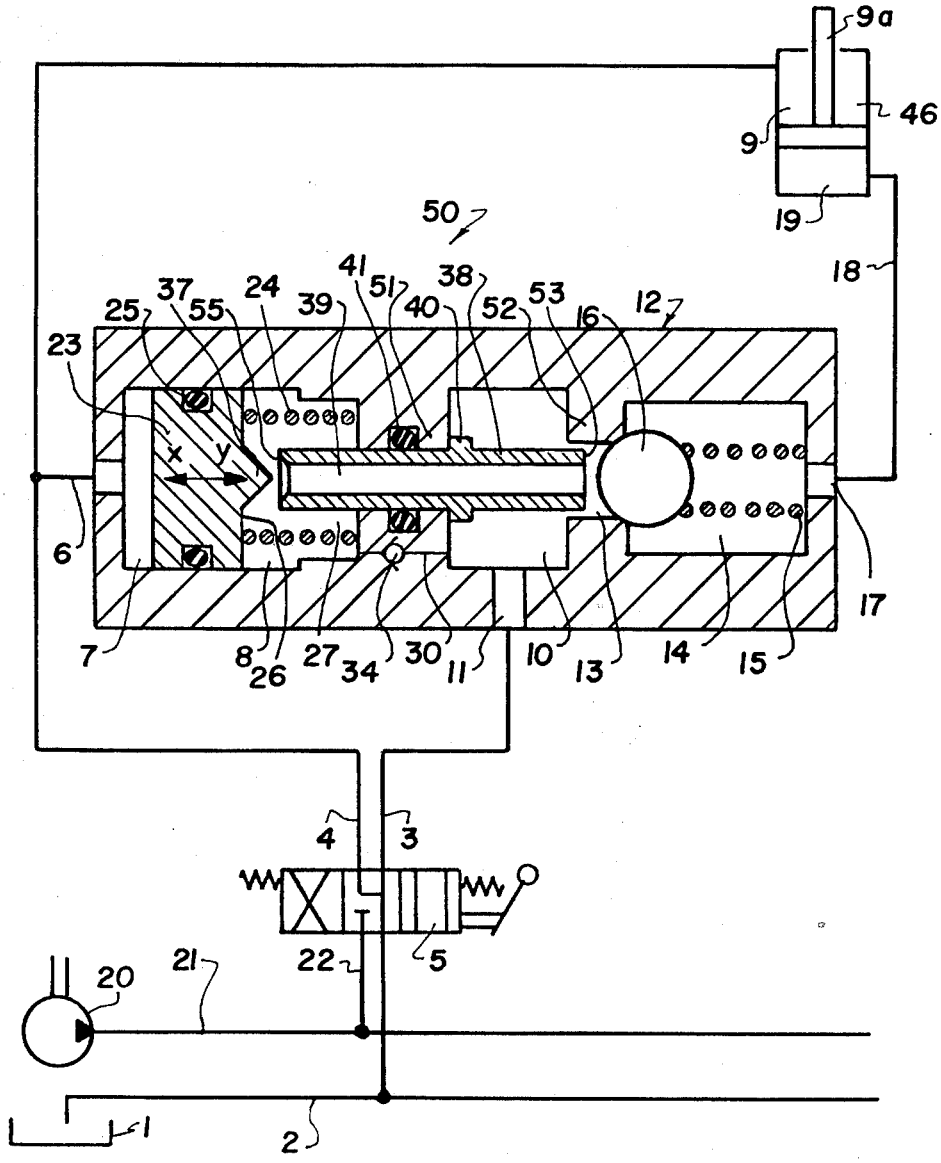
FIG. 2 illustrates an alternate embodiment of a valve according to the invention in longitudinal cross-section as in FIG. 1.
Figure 3:
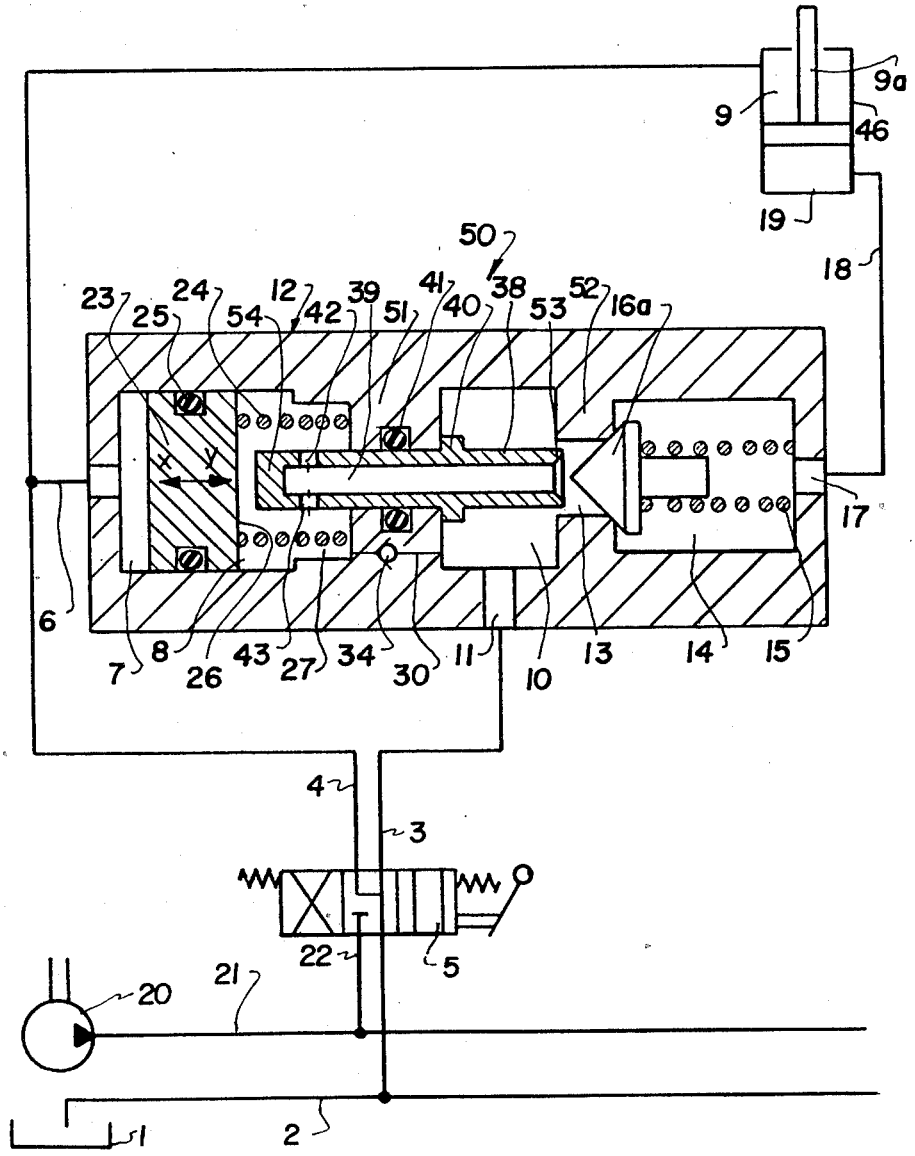
FIG. 3 illustrates still another alternate embodiment of a valve according to the invention in a longitudinal cross-section as in FIG. 1.
Figure 4:
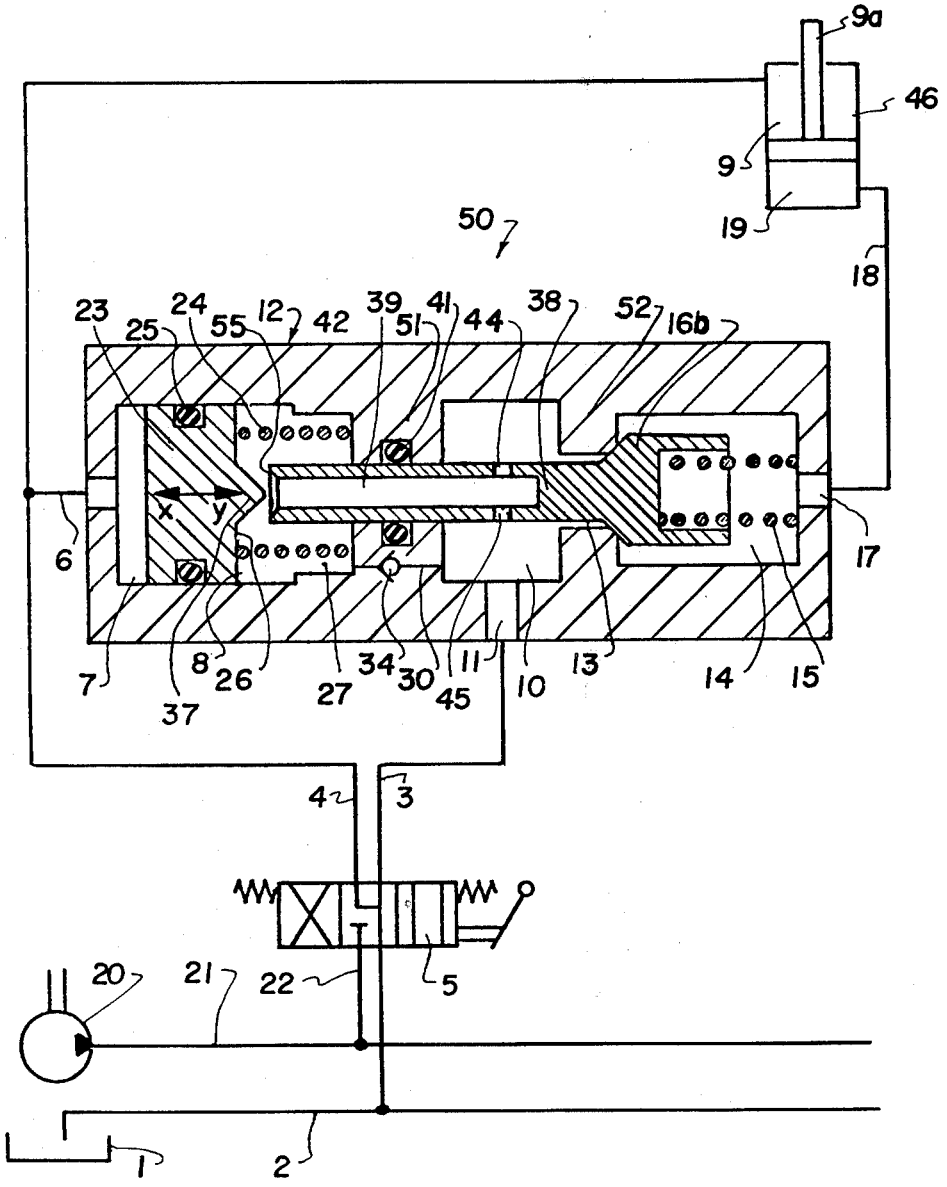
FIG. 4 illustrates even still another alternate embodiment of a valve according to the invention in a longitudinal cross-section as in FIG. 1.

In the alternate embodiments, illustrated in FIGS. 2,3 and 4 a check valve 34 is similarly arranged with bypass 30, which opens in direction Y, that is in the direction of outlet chamber 10. Piston rod 31 is traversed in the embodiment of FIG. 1, substantially over its entire length, by a centric axial channel 35, which communicates at one end with control space portion 27 through an ouflow channel 36 and, at the other end, centrically with outlet chamber 10 and channel 11 respectively. The portion of rod 31 about the centric outlet is designed as a valve seat 53 and is adapted to sealingly engage shutoff device 16. Thus, when the centric valve seat 53 bears on shutoff device 16, axial channel 35 is sealed in a fluid-tight manner by shutoff device 16.

In the embodiment according to FIG. 2, piston-type control element 23 has a valve body 37 which is formed integrally with control element 23. The valve body 37 projects from the surface of element 23 into the bore of a tubular piston rod 38 which is designed as a cylindrical pipe, in a fluid-tight manner. Piston rod 38 can be displaced independently of control element 23. Tubular piston rod 38 is provided with a central axis channel 39. In addition, piston rod 38 has an annular projection or collar 40, integrally mounted to its outer surface thereof, which limits the movement of piston rod 38 in direction X. Piston rod 38, moving separately from control element 23, can be sealingly displaced in a fluid-tight manner in direction X or Y. A seal 41 is provided on it outer surface in contact housing 12 in annular extension 51.

The surface of piston rod 38 facing shutoff device 16 is also designed as a valve seat, so that, when piston rod 38 bears on shutoff device 16, axial channel 39 is closed in a fluid-tight manner by shutoff device 16.

The embodiment of FIG. 3 differs from that of FIG. 2 in that control element 23 does not include valve body 37, but is flat on its surface exposed to or facing the separate piston rod 38. Axial channel 38 is closed or centrally sealed in a fluid-tight manner at its end 54 facing control space portion 27 but, in the represented embodiment, is provided with two connecting openings 42, 43 extending radially, but in diametrically opposite directions, which communicate with control space portion 27.

Shutoff device **16*a* is formed with a conical shape and is pointed and extends sealingly into axial channel 39. Channel 39 is equipped at the end adjacent the shutoff device with a valve seat 53 for sealing engagement when piston rod 38 bears on shutoff device 16**.

In the embodiment of FIG. 4, channel 39 is sealed in a fluid-tight manner at its front end adjacent to shutoff device **16*b*, but is connected in a fluid-conducting manner to outlet chamber 10 over coaxially opposed connecting openings 44, 45. The axial channel 39 of piston rod 38 opens centrically into control space portion 27. The periphery of the piston rod 38 about centric opening is designed as a valve 55 which can be made to bear tightly against valve body 37, integrally connected to control element 23**.

The operation of the various embodiments shown in the drawings will now be described in detail. When setting the piston-cylinder unit, for example, a hydraulic prop 46, pressure fluid pipe 21 is connected to return pipe 3, through an appropriate alignment of multi-way valve 5, so that pressure fluid flows through opening channel 11, into outlet chamber 10, and into connecting channel 13 thereby lifting shutoff device 16 from its seat against the restoring force of spring element 15. Pressure fluid then flows through valve chamber 14 and channel 17 through pressure pipe 18 and pressurizes setting space 19 of the piston-cylinder unit so that prop rod **9*a* extends and the respective prop 46 is set. At the same time, pressure fluid flows, in the embodiment of FIG. 1, through axial channel 35 and outflow channel 36 into control portion 27 and subjects face 26 of control element 23 to pressure forces to cause control element 23** to displace.

In the embodiment according to FIG. 2, pressure fluid flows through axial channel 39 of tubular piston rod 38 and into control space portion 27.

The pressure fluid entering outlet chamber 10, in the embodiment according to FIG. 4, flows through openings 44 and 45 into axial channel 39 and, from there, into control space portion 27.

When the necessary setting pressure has been attained and the setting operation is completed, multiway valve 5 is brought into the position shown in FIGS. 1 to 4, that is, pressure fluid pipe 21 is disconnected from fluid communication with setting space 19. This results in a return movement of shutoff device 16 into its sealing position on annular extension 52. In addition, outlet chamber 10 is connected over return pipe 3 to return flow channel 2 via multiway valve 5.

At the same time, return pipe 4 is connected to the return flow channel 2, so that control element 23 is subjected on both of its sides to the same pressure and hence, is balanced. Any back pressure in return flow channel 2, and thus in return pipes 3 and 4 would result in the same pressure conditions on both sides of the piston-type control element 23, that is, the valve would remain in a balanced or neutral position so that accidental unlocking of shutoff device 16 is impossible.

If the piston-cylinder unit, for example, a hydraulic timbering block, is to be retracted, return pipe 4 is connected over multiway valve 5 to pressure fluid pipe 21, so that, on the one hand, the prop rod space 9 is filled with pressure fluid and, on the other hand, the piston-type control element 23 is subjected to pressure fluid over line section 6. This results in all embodiments in a displacement of control element 23 in direction Y, hence in the direction of shutoff device 16. In the embodiment according to FIG. 1, the pressure fluid enclosed in control space portion 27 is forced out, during the displacement through bypasses 28 and 29 into outlet chamber 10. After a certain stroke, piston rod 31 impinges with its valve seat on shutoff device 16 and displaces the shutoff device from its valve seat on the inner surface of the housing extension 53. At the same time, however, axial channel 35 is sealed in a fluid-tight manner against the shutoff element. The pressure fluid in setting space 19 can thus flow off through valve chamber 14, connecting channel 13, outlet chamber 10 and return pipe 3 to return flow channel 2, that is, the piston-cylinder unit retracts. The expansion blow cannot act, however, on annular face 26, since any connection leading thereto from setting space 19 is sealed fluid-tight.

In the embodiment shown in FIG. 2, control element 23 impinges with its valve body 37 on the valve seat of tubular piston rod 38 during the process, that is, when control space portion 7 is filled with pressure fluid, and seals the axial chamber 39. Any pressure fluid enclosed in control space portion 27 is displaced over check valve 34 into outlet chamber 10. After an additional stroke, piston rod 38 moves toward shutoff device 16 and displaces the latter from its seat into the open position. The opening of this tubular piston rod 38 adjacent to sealing element 16 need not necessarily be designed as a valve seat on its side facing shutoff device 16, since the opposite opening, which cooperates with valve body 37, is designed as a fluid-tight valve seat 55. Here, too, the hydraulic expansion blow cannot act in control space portion 27, since there is no fluid communication between setting space 19 and and portion 27 after shutoff device 16 has been opened.

The same holds true for the embodiment according to FIG. 3 where control element 23 impinges, after a certain stroke, on tubular piston rod 38, which is closed at the front end 54, thereby pushing the latter against shutoff device 16, which seals axial channel 39, likewise in a fluid-tight manner, before it lifts from its valve seat and allows the pressure fluid enclosed in setting space 19 to flow off to return pipe 3.

The effect of the embodiment shown in FIG. 4 is similar to that in FIG. 2, since here too control element 23 cooperates sealingly after a certain stroke in direction Y with valve body 37 and a corresponding valve seat at the adjacent opening of axial channel 39. Only after a further movement of control element 23, does shutoff device 16 lift off from its valve seat, so that any expansion blow has no fluid-conducting connection to control element 23. In this way, a recovery and setting valve is obtained which, in any case, is pressure compensated, thus neutral, both in the rest position and engaged position with which, in addition, the dreaded pressure-relief shock occurring at the start of the recovery operation cannot lead to the mentioned vibration or fluttering of the valve.

While specific embodiments of the invention have been shown and described in detail to illustrate the application of the principles of the invention, it will be understood that the invention may be embodied otherwise without departing from such principles.

What is claimed is:

1. An improved valve for use in underground mining in connection with a piston cylinder unit having a member slidably mounted in the bore of the cylinder for displacement responsive to fluid pressure in a first and second compartments in the cylinder on opposite sides of the member comprising an elongated housing having a control chamber, a valve chamber, and an outlet chamber intermediate said control chamber and said valve chamber, a piston member slidably mounted for axial displacement within said control chamber in fluid-sealing contact with said housing to divide said control chamber into a first control chamber portion and a second control chamber portion, first spring means within said second control chamber portion for resiliently biasing said piston member in a first direction toward said first control chamber portion, first channel means for establishing fluid communication between the first compartment and said first control chamber portion, second channel means for establishing a path of fluid communication between said second compartment and said outlet chamber through said valve chamber, shutoff means in said valve chamber for closing said path, said shutoff means being operative responsive to the displacement of said piston member in a second direction opposite said first direction over a first predetermined distance to open said path, connection means for establishing fluid communication between said second control chamber portion and said outlet chamber, said piston member being displaceable in said second direction over a second predetermined distance less than said first predetermined distance to shutoff fluid communication between said second control chamber portion and said outlet chamber, said connection means fluidly interconnecting said second control chamber portion and said outlet chamber when said piston member is in a neutral position disposed at a distance in said second direction less than said second predetermined distance.

2. An improved device as set forth in claim 1, wherein said piston member comprises an elongated piston rod connected at a first end to said piston member and projecting through said second control chamber portion toward said shutoff means, means for axially guiding said piston rod, said piston rod having an axial channel extending therethrough forming said connection means between said second control chamber portion and said outlet chamber and centrically terminating in a second end of said piston rod, said second end forming a seating surface for sealingly engaging said shutoff means, a check valve mounted on said piston rod in said outlet chamber, a bypass line for establishing fluid communication between said second control chamber portion and said outlet chamber, second spring means in said outlet chamber for resiliently urging said check valve toward said control chamber to close said bypass line for preventing backflow from said outlet chamber to said second control chamber portion.

3. An improved device as set forth in claim 1 further comprising a tubular rod axially displaceably mounted to said housing in a fluid-tight manner intermediate said second control chamber portion and said outlet chamber, said rod having a longitudinal axial channel extending therethrough to form a said connection means between said second control chamber portion and said outlet portion, said portion member being displaceable in said second direction to engage said rod and seal said axial channel at a first end, and said rod having a second end forming a seating surface for sealing engaging said shutoff means.

4. An improved device as set forth in claim 1 further comprising a tubular piston rod axially displaceably mounted to said housing in a fluid-tight manner intermediate said second control chamber portion and said outlet chamber, said piston rod having a longitudinal channel extending therethrough to form said connection means between said second control chamber portion and said outlet portion, and said piston rod having an end forming a seating surface for sealing engaging said shutoff means.

5. An improved device as set forth in claim 1, further comprising an elongated rod connected at a first end to said shutoff means, said elongated rod projecting into said second control chamber portion toward said piston member, means for axially guiding said elongated rod, said elongated rod having an axial channel extending therethrough forming said connection means between said outlet chamber and said second control chamber portion and centrically terminating in a second end of said elongated rod, and said second end forming a seating surface for sealingly engaging said piston member.

6. An improved device as set forth in claim 5 further comprising a bypass line for establishing fluid communication between said second control chamber portion and said outlet chamber, and a check valve in said bypass operative responsive to the pressure in said second control chamber portion and said outlet chamber to close said bypass line for preventing backflow from said outlet chamber to said second control chamber portion.

* * * * *